US005494015A

United States Patent [19]

Rynhart

[11] Patent Number: 5,494,015

[45] Date of Patent: Feb. 27, 1996

[54] FUEL INJECTOR ASSEMBLY

[75] Inventor: Derek Rynhart, Bantry, Ireland

[73] Assignee: Rynhart Research and Development Company Limited, Bantry, Ireland

[21] Appl. No.: 232,222

[22] PCT Filed: Nov. 5, 1992

[86] PCT No.: PCT/IE92/00020

§ 371 Date: Aug. 8, 1994

§ 102(e) Date: Aug. 8, 1994

[87] PCT Pub. No.: WO93/09343

PCT Pub. Date: May 13, 1993

[30] Foreign Application Priority Data

Nov. 5, 1991 [IE] Ireland ..... 3856/91

[51] Int. Cl.[6] ..... F02M 3/00; F02B 5/00

[52] U.S. Cl. ..... 123/294; 239/584

[58] Field of Search ..... 123/294, 305, 123/435, 467, 470–471; 239/584, 572, 88, 91

[56] References Cited

U.S. PATENT DOCUMENTS

| | | | |
|---|---|---|---|
| 2,708,601 | 5/1955 | Links | 123/294 |
| 3,801,021 | 4/1974 | Jakob | 239/584 |
| 4,350,301 | 9/1982 | Erwin et al. | 239/584 |
| 4,360,163 | 11/1982 | Williams | 239/584 |
| 5,127,584 | 7/1992 | Sczomak | 239/584 |
| 5,211,145 | 5/1993 | Ichikawa et al. | 123/305 |

*Primary Examiner*—Thomas N. Moulis

*Attorney, Agent, or Firm*—Jacobson, Price, Holman & Stern

[57] ABSTRACT

A compression operated fuel injector assembly (1) for an internal combustion engine. The injector assembly (1) has a body (2) with a bore (8) having a gas passage (9) at one end for communication with an engine combustion chamber. A piston (7) is slidable in the bore (8). A fuel pump (5) is mounted within the body (2) having a plunger (14) which is mounted on the piston (7) for reciprocal pumping movement within a complementary fuel pump cyclinder (15) for delivery of fuel to a nozzle assembly (6). The nozzle assembly (6) is mounted on the piston (7) and projects through the gas passage (9). The piston (7) is urged downwardly by a timing spring (16) so that a valve head (18) on the nozzle assembly (6) engages a valve seat (19) until the pressure of combustion chamber gases acting on the outer portion of the nozzle (6) is sufficient to overcome spring pressure and move the piston (7) upwardly opening the passage (9) to the piston (7) so that the gases snap the piston (7) upwardly due to the increased area exposed to the gases. Collets (20) at an outer end of the gas passageway (9) form a gas tight seal with a second valve head (21) on the nozzle assembly (6) when the piston (7) snaps inwardly to retain purging air within the bore (8) and seal the bore (8) during combustion to exclude combustion gases. When cylinder pressure drops at the end of the power stroke the spring (16) moves the piston (7) outwardly to blow down the purging air into the cylinder for improved scavenging.

24 Claims, 5 Drawing Sheets

FUEL INJECTOR ASSEMBLY

The invention relates to a fuel injector assembly for the injection of fuel into a combustion chamber of an internal combustion engine and in particular to cylinder compression pressure actuated fuel injector assemblies.

Examples of pressure actuated fuel injector assemblies are shown in Patent Specification No's DE 661,468, DE 688,311, DE 708,739, FR 799,951, FR 849,154, U.S. Pat. No. 2,589,505, U.S. Pat. No. 2,602,702, U.S. Pat. No. 2,740,667 and U.S. 2,740,668. Such cylinder pressure fuel injector assemblies have considerable advantages particulary for 2-stroke engines. These are sometimes erroneously referred to as pumpless diesel injector units. Cheap, small displacement, internal-combustion engines working on the compression ignition principle have been much sought after for many years. Cost is a major factor in the almost total absence of the availability of small diesel engines except for specialised applications where cost is a secondary factor. Efforts to design and develop a low cost fuel injector assembly, which would be actuated by combustion chamber pressure has heretofore proved unsuccessful. The aforementioned patent specifications demonstrate quite clearly that this problem has been long appreciated and that the way forward was to combine together within the injector assembly unit itself the pumping function. Thus, the so called pumpless diesel injector unit. It is long recognised, as these patent specifications adequately demonstrate, that some form of pump could be provided which could be readily easily actuated in this manner. Unfortunately, all these fuel injector assemblies suffered from serious drawbacks. A primary drawback is that there was very often, if one was to get efficient combustion, a need to provide a secondary combustion chamber. In many cases the injection pressures were not sufficient to have the injection operation carried out at pressures equivalent to those of more conventional separate pump and injector units. These units as will be referred to again below also had a major disadvantage in respect of contamination by the combustion gases. There were other problems with priming and efficiency generally.

Many attempts were made to overcome the problems of injection pressure and general fuel atomisation.

This problem of injection pressure and atomisation was overcome many years ago by what was in effect a 2-stage lift injection process. When this solution to the problem, which was first disclosed in DE 688311, was achieved the remaining problems were such as to prevent the practical application of the 2-stage lift system from such fuel injector assemblies. The problems that had heretofore been minor, now become major and have prevented the application of pressure actuated fuel injector assemblies to small displacement internal combustion engines working on the compression ignition principle.

As stated, this invention is particularly concerned with the type of injector shown in DE 688,311, said injector assembly being of the type comprising an injector body and two-stage snap-action lift stepped piston mounted in a bore in the injector body having a gas passage at one end for communicating with an engine combustion cheer, the piston having a wider part slidable within the bore and a narrowed part extending through the gas passage and urged by a timing spring into engagement with a first internal sealing land for the gas passage to form a gas-tight seal until the pressure of combustion chamber gases acting on an outer portion of the narrowed part is sufficient to overcome spring pressure and move the piston for inlet of combustion chamber gases to act on the wider part of the piston whereby the piston snaps inwardly under the increased force acting against the spring due to the increase in exposed area acted on by the gases, valve means for sealing the gas passage when the piston is moved inwardly, a fuel pump mounted on the piston, the pump comprising a plunger for reciprocal pumping movement within a complementary fuel pump cylinder communicating with the bore to deliver a measured quantity of fuel to a nozzle assembly mounted on the outer end of the piston in the gas passage, the nozzle assembly forming part of the narrowed part of the piston, through a fuel passage in piston between the fuel pump cylinder and the nozzle assembly. A disadvantage of this injector, and indeed the aforementioned injectors, is the fact that during combustion, combustion gases enter the bore which leads to build-up of carbon deposits within the gas cylinder adversely affecting operation of the piston and the sealing of the piston with the bore. In DE 688,311 as the cylindrical nozzle is drawn up into the associated cylindrical gas passage it restricts entry of combustion gases into the bore, however, due to the need to maintain a running clearance there will be a certain amount of blow-by of combustion gases into the bore.

The present invention is characterised in that the valve means is formed by a second external sealing land for gas passage and the nozzle assembly which is engageable against the second external sealing land upon inward ping of the piston to form a gas tight seal for retention of purging air. Thus advantageously combustion gases are not allowed enter the bore which is closed during combustion of gases within the engine cylinder. There is therefore no carbon build-up within the bore which would adversely affect operation of the piston and in particular The sealing between the piston and the bore. This particularly advantageous where fuel is retained an a rear of the piston. A continuous seal can provided on the piston to prevent fuel leakage past the piston. High temperatures due to combustion gases are not generated within the injector and therefore there is no scaling of carbon within the bore. Further as only relatively low temperatures are generated within the bore a lower category of sealing material can be used between the piston and bore as it does not have to withstand high temperatures. A further advantage is that the air retained within the bore during combustion is subsequently released when the combustion chamber pressure drops off to provide a blow down of fresh air in the engine combustion cheer giving improved scavenging and cleaner running of the engine. This use of the purging air is advantageous to improve combustion efficiency and as such is extremely advantageous. There is in practice another advantage with the particular injector assembly by having this purging air retained within the bore. The parts of the nozzle assembly are thus constantly in contact with the cleanest possible air available. That cleanest possible air is then used itself to blow down past the nozzle assembly to direct residual combustion gases away from the nozzle assembly and out of the engine cylinder. Therefore, the air that is in contact with the nozzle is much cleaner than could normally be expected to be the case. Thus, there are two advantages of the construction, not just simply in the purging and increased combustion efficiency that occurs because of this additional blow down but by the fact that residual combustion gases are kept as far away from the injector assembly as possible. It is readily appreciated that the more contaminants that can be kept away from the injector assembly the more efficiently the injector assembly will operate and the longer its life will be.

In a preferred embodiment of the invention the second external sealing land is provided adjacent an outer end of the gas passage to isolate the interior of the injector assembly from combustion gases.

In a particularly preferred embodiment the nozzle assembly projects through the gas passage beyond the injector body forming with the gas passage surface a gas inlet until the piston snaps inwardly, the surface of the gas passage which engages the nozzle assembly forming the second external sealing land.

In another embodiment the nozzle assembly outer surface and gas passage surface defining the gas inlet are so convergently shaped as to reduce the size of the gas inlet as the piston moves inwardly. Thus advantageously, the air pressure within the bore is restricted in order that the timing spring force will be adequate to break the seal between the nozzle assembly and the second external sealing land. Also the engine compression ratio is improved by allowing less air to enter the bore from the engine cylinder.

In a further embodiment a pair of co-axially mounted spaced-apart valve heads are formed on an exterior of the nozzle assembly for engagement with the external and internal sealing lands which are formed at an outer end and an inner end of the gas passage respectively. Ideally the valve heads and the lands are frusto-conical in shape.

In another embodiment, a resilient buffer is provided for absorbing shock on nozzle assembly engagement with the second external sealing land. This advantageously improves the reliability and working life of the injector assembly by reducing the possibility of stress fracture in the nozzle assembly and excessive wear on the mating faces of the nozzle assembly and the second external sealing land by cushioning their inter-engagement. Preferably, the resilient buffer is formed by a resilient annular seal between the inner face of the piston and a facing annular stop shoulder on the bore. Ideally, the annular seal is so arranged as to trap on engagement a quantity of liquid fuel between the piston and the bore for an additional hydraulic buffer. Thus advantageously the nozzle assembly and second external sealing land are further protected against stress fracture and excessive ware.

In a particularly preferred embodiment, the annular seal is separately slidable within the bore and engageable between the piston and the bore, the piston and seal together forming an annular liquid flow throttling passageway. Preferably, the annular seal comprises a rigid ring support carrying a resilient seal material on its upper surface, a lower surface of the ring support cooperating in use with portion of the surface of the piston to form the throttling passageway. Further cushioning of the inter-engagement of the nozzle assembly and the second external sealing land is thus conveniently achieved, the throttling of liquid fuel flow behind the piston within the injector having a braking effect acting against inward piston movement. Preferably, the cooperating surfaces are not parallel thus avoiding full face to face contact over their cooperating surface.

In a further embodiment, the area of the wider part of the piston, the area of an outer face of the nozzle assembly, and the timing spring force rating are selected such that the spring force acting on the piston will be greater than the combined inward force of the trapped purging air on the piston and cylinder gases on the nozzle assembly at or immediately prior to exhaust of cylinder gases. This advantageously gives a blow down effect by the air released from the injector after combustion. It occurs at or just before combustion gases are exhausted at the end of the power stroke. This is particularly important for two-stroke engines where scavenging is always a problem. On modern two-stroke engines external pumps are sometimes used to inject air into the cylinder to aid scavenging but advantageously, the injector according to the present invention does this as an integral part of its operation and so eliminates the need for external pumping.

In a particularly preferred embodiment the fuel pump plunger has a helical spill groove extending along an exterior of the plunger from a free end of the plunger for cooperation with a spill port in a side wall of the fuel pump cylinder to regulate the quantity of fuel injected by each pump stroke, the cylinder rotatable on the plunger to adjust the effective stroke of the pump, rotation of the cylinder operating a spring cam for adjustment of the timing spring bias in response to the measured quantity of fuel injected, the spring cam comprising a pair of mating co-axial rings, the mating surfaces forming cam and cam follower surfaces respectively, one ring being held on the body and the other ring engaging the spring and encompassing the fuel pump cylinder being keyed thereon for relative longitudinal movement thereon and hence adjustment of the spring. Thus advantageously injection timing can be automatically advanced as the engine speeds up and retarded as it slows down.

In another embodiment the nozzle assembly comprises a nozzle body having a through bore for reception of a complementary spring-loaded needle valve to close an atomiser at an outlet of the nozzle body, means for fuel delivery from the fuel pump to the outlet, the needle being biased into a closed position by one or more disk springs mounted between the needle and the nozzle body. The use of disk springs gives a mass and size reduction which assists in miniaturising the injector where required.

In a further embodiment a non-return valve is provided at the fuel spill port on the fuel pump cylinder. Ideally the non-return valve is formed by a resilient compression ring which is mounted around the cylinder covering the spill port, the compression ring deformable outwardly for discharge of fuel from the fuel pump cylinder. It is particularly desirable to stop fuel entering the fuel pump cylinder back through the spill port as this fuel will have been aerated within the body of the injector due to the reciprocating movement of the nozzle assembly within the injector body.

In a further embodiment a non-return valve is provided at a fuel inlet to the fuel pump cylinder. The non-return valve may comprise a valve spring loaded into engagement with a fuel inlet opening in a sidewall of the fuel pump cylinder. In an alternative arrangement, the non-return valve comprises a ball loosely mounted within a carrier housed within the cylinder at a fuel inlet opening in the cylinder sidewall for movement against and away from the opening in response to fuel pressure.

Preferably additional means is provided for calibration of spring tension, and hence the initial injection set point independently of the fuel pump setting. Ideally the additional means is a height adjusting cam formed by a ring gear having an upstanding cam head engagable with a cam surface formed on the spring cam, the ring gear being rotatable by a cooperating bevel gear driven by a shaft mounted on and extending through a side wall of the injector body. This arrangement advantageously allows the initial injection point setting to be set and locked. It can also be readily easily adjusted if necessary, for example, to compensate for a fall off in cylinder compression or for a fall off in spring rate of the timing spring.

In another embodiment the wider part of the piston is formed by a resilient diaphragm extending between the nozzle body and a side wall of the gas cylinder.

In a further embodiment the second external sealing land at an outer periphery of the gas passage is formed by a pair of split collets releasably secured at an outer end of the gas passage. Advantageously the collets can be readily easily changed if worn.

The invention will be more clearly understood by the following descriptions of some embodiments thereof, given by way of example only, with reference to the accompanying drawings, in which.

Figure 1:
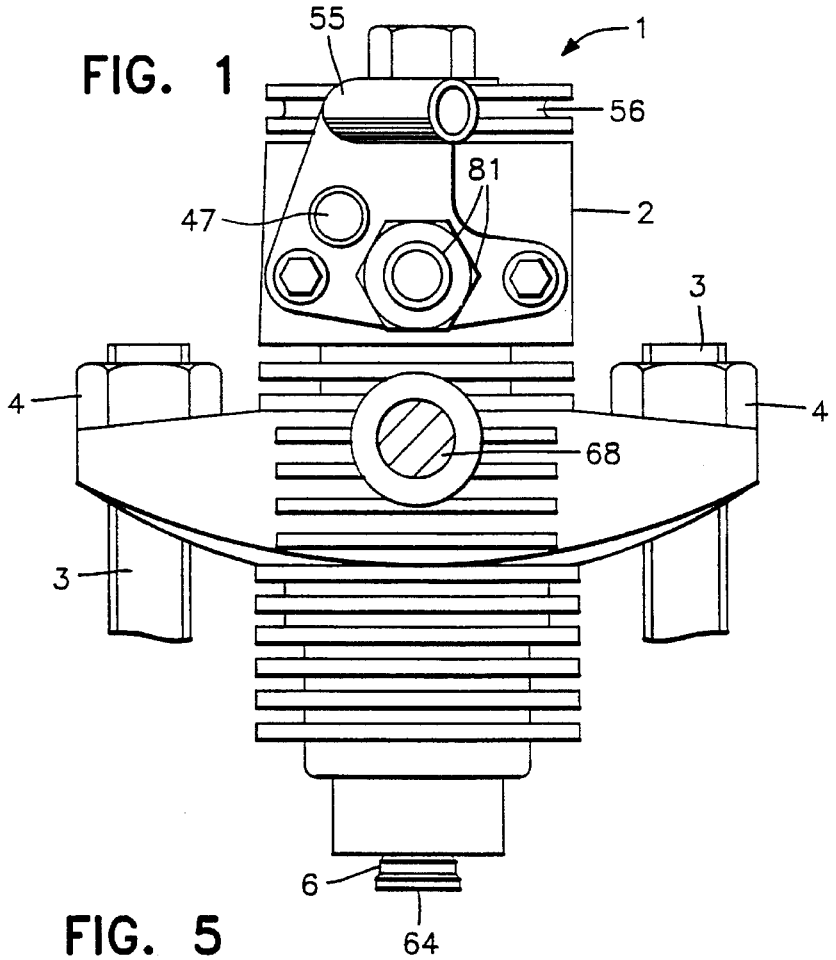
FIG. 1 is an elevational view of a fuel injector assembly according to the invention.
Figure 5:
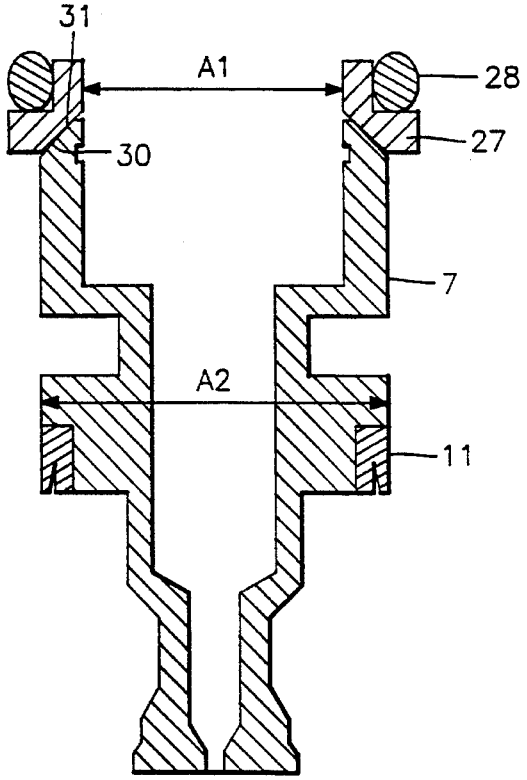
FIG. 5 is a detailed sectional elevational view of portion of the injector assembly.
Figure 4:
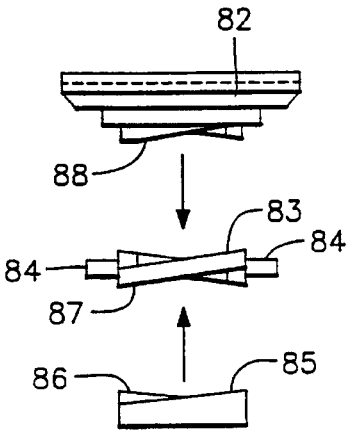
FIG. 4 is an exploded detailed view of a cam arrangement for adjustment of the injection point of the injector.
Figure 2:
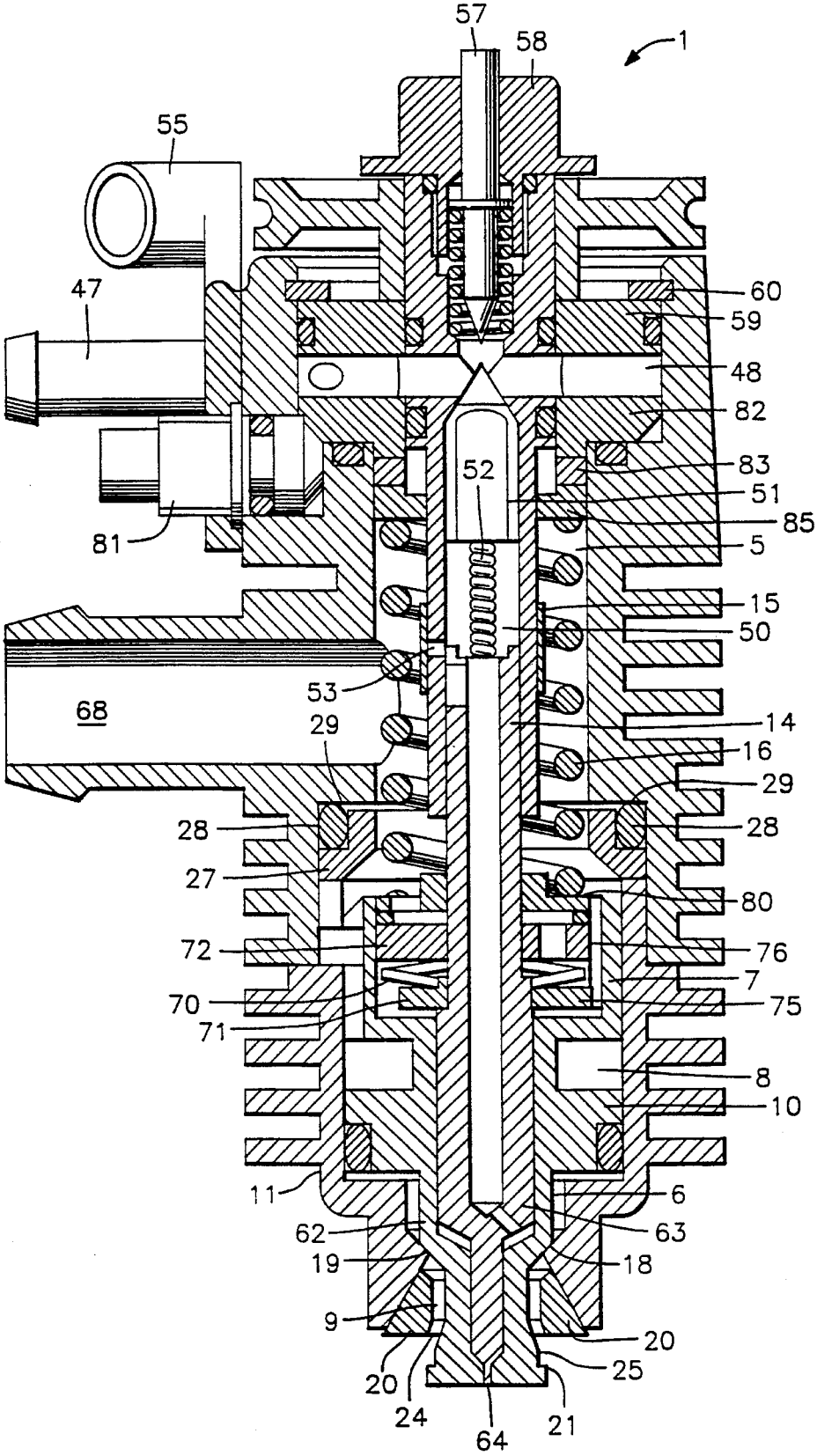
FIG. 2 is a sectional elevational view of the injector assembly shown in one position.

Referring to the drawings and initially to FIGS. 1 to 5 thereof, there is illustrated a fuel injector assembly according to the invention indicated generally by the reference numeral 1. The injector 1 has a body 2 which can be mounted on the cylinder of an internal combustion engine by mounting studs 3 and retaining nuts 4. Within the body 2 is a fuel pump indicated generally at 5 communicating with an associated nozzle assembly 6 for pressurising and discharging atomised fuel into an engine combustion chamber.

A piston assembly 7 is mounted in a stepped bore 8 in the injector body 2, the bore 8 having a gas passage 9 at one end for communication with the engine cylinder. The piston assembly 7 has a wider part 10 slidable within the bore 8. A seal 11 mounted on the wider part 10 forms a seal between the wider part 10 and an inner side wall of the bore 8. A narrowed outer part of the piston assembly 7 is formed by the nozzle assembly 6 which extends through the gas passage 9. A fuel pump plunger 14 is co-axially mounted on the piston assembly 7 and extends inwardly for reciprocal pumping movement within a complementary fuel pump cylinder 15 to deliver a measured quantity of fuel to the nozzle assembly 6.

A timing spring 16 urges the piston assembly 7 downwardly so that a frusto-conical valve head 18 formed on an exterior of the nozzle assembly 6 seats against an associated internal sealing land formed by a frustoconical valve seat 19 formed at an inner end of the gas passage 9 to form a gas-tight seal therewith. A pair of split collets 20 form a second external sealing land at an outer end of the gas passage 9 engagable by a valve head 21 formed at an outer end of the nozzle assembly 6 to form a gas-tight seal to prevent entry of combustion gases into the bore 8 when the piston assembly 7 moves inwardly in response to combustion chamber pressure.

Figure 3:
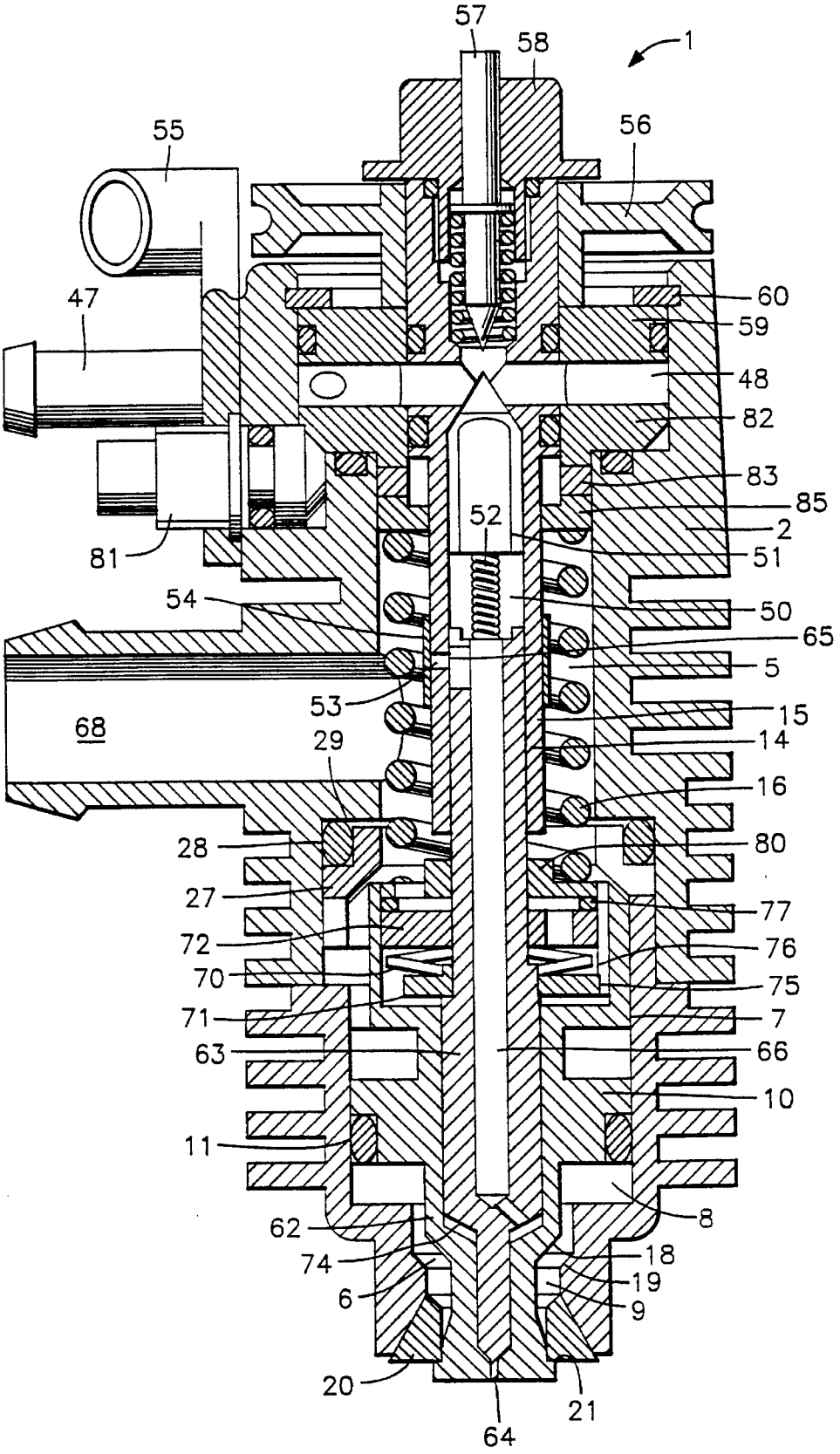
FIG. 3 is a view similar to FIG. 2 showing the injector assembly in another working position.

The nozzle assembly 6 projects through the gas passage 9 beyond the injector body 2 forming an annular gas inlet 24 (FIG. 2) until the piston assembly 7 snaps inwardly to seal the nozzle assembly 6 against the collets 20 (as shown in FIG. 3). It will be noted that a shoulder 25 on the nozzle assembly 6 extending inwardly of the valve head 21 reduces the size of the inlet 24 as the piston assembly 7 moves inwards. This limits the air pressure within the bore 8 in order that the timing spring 16 force will be adequate to break the seal between the collets 20 and valve head 21 after injection and also to improve the engine compression ratio by allowing less air to enter the bore 8 from the engine cylinder.

In order to prevent stress fracture in the nozzle assembly 6 and excessive wear on the collets 20 when they snap together a buffer 27 carrying a resilient compression ring 28 is mounted at an inner end of the piston assembly 7 for engagement against an annular stop shoulder 29 within the bore 8. Thus the nozzle assembly 6 is cushioned momentarily before it contacts the collets 20. The buffer 27 is so arranged as to trap on engagement a quantity of liquid fuel between the piston assembly 7 and the bore 8 for an additional hydraulic buffer. As the piston assembly 7 and buffer 27 move together an annular liquid flow throttling passageway is formed therebetween. Also (see FIG. 5) the engaging faces 30, 31 of the piston assembly 7 and the buffer 27 respectively have different angles so that they seat on their inner diameter thereby creating an area differential between the area of the seal 11 (A2 FIG. 5) and the contact area (A1 FIG. 5) between the piston assembly 7 and the buffer 27 thus giving a positive hydraulic brake aiding the cushioning effect of the buffer 27.

The injector 1 has a fuel supply port 47 through which fuel is gravity fed into an annular space 48 around the cylinder 15 forming portion of the fuel pump 5. The cylinder 15 has a fuel cup 50 with a needle check valve 51 which is biased closed by a spring 52. A spill port 53 extends through a side wall of the cylinder 15 and has a non-return valve 54 in the form of a compression ring which prevents fuel from being drawn into the fuel cup 50 through the spill port 53 as it becomes aerated by the reciprocating action of the nozzle assembly 6. The cylinder 15 can be rotated for the purposes of fuel metering by means of a cable (not shown) which passes through a cable retainer 55 and is attached to a pulley 56 which is fixed to the top of the cylinder 15. Within a top portion of the cylinder 15 there is a valve tickler 57 which is spring loaded away from the check valve 51 and is retained by a screw 58, for the purposes of unseating the check valve 51 to clear air from the fuel cup 50. The valve tickler 57 can also be used as an engine emergency cut-off by holding the check valve 51 off its seat. The cylinder 15 is retained in the body 2 by a cap 59 and circlip 60.

The nozzle assembly 6 comprises a nozzle body 62 having a through bore for reception of a complementary spring-loaded needle valve 63 to close an atomiser 64 at an outlet of the nozzle body 62. An upper portion of the needle 63 forms the fuel pump plunger 14 which slidably engages within a lower portion of the fuel cup 50. A helical spill port 65 is machined into an outer cylindrical surface of the plunger 14. The nozzle assembly 6 reciprocates in response to combustion chamber pressure and so the plunger 14 slides up and down within the fuel cup 50 creating a pumping action. On the downward stroke the check valve 51 is lifted off its seat by the fuel entering the fuel cup 50 from the annular space 48 above. Then on the upward stroke the check valve 51 seats and fuel is forced down through a passage 66 in the needle 63 and is injected into the combustion chamber of the engine through the atomiser 64 at the bottom of the nozzle body 62. The helical spill port 65 on the needle 63 cooperates with the spill port 53 on the cylinder 15, and during pumping the cylinder 15 can be rotated, adjusting the relative orientation of the helical spill port 65, and the spill port 53 to meter the quantity of fuel injected by changing the effective stroke of the plunger 14. Excess fuel which spills off through the spill port 53 accumulates within the body 2 offering lubrication and cooling to the injector 1, and finally returns to the fuel tank through a fuel return port 68.

The needle 63 is biased downwards by two Belleville type disk springs 70 which are pre-loaded to give the desired injection pressure. The disk springs 70 are held between a needle washer 71 and a disk spring retainer 72, both of which have locating bosses, and when assembled leave a needle lift or snap clearance between them. Ideally the disk spring force would not require adjustment, but if it were required, the thickness of the disk spring retainer 72 could be varied or shimmed to change the pre-load. During the pumping stroke, fuel which is forced down through the needle 63 acts on an area 74 at a lower end of the needle 63 which is greater than that area exposed within the fuel cup 50, thus causing the needle 63 to lift by the amount of the snap clearance. The needle 63 must be prevented from rotating as this would upset the fuel metering, and this is achieved by a flat portion which is machined onto its outer cylindrical surface in the position where the needle washer 71 is fitted, and the needle washer 71 has on its inner cylindrical surface a matching flat portion which interlocks with the flat on the needle 63. The needle washer 71 has on its outer circumferential edge a tab 75 which locates into a groove slot 76 machined into an inner cylindrical surface of a stepped upper portion of the piston assembly 7. A retaining circlip 77 holds the nozzle assembly 6 together. The atomiser 64 is a conventional pintle type atomiser which is not part of the invention. It will be noted therefore that other types of atomisers could alternatively be used.

The nozzle assembly 6 is biased downwards by the timing spring 16 with its associated locating washer 80. The force of the timing spring 16 is adjustable by means of a cam arrangement. A timing screw 81 is gear linked to a height adjusting cam 82 formed by a ring gear for rotation of the ring gear. An underside of the height adjusting cam 82 forms an upstanding cam head 88 which runs on a cam washer 83 when it is rotated. The cam washer 83 is raised or lowered by this action which in turn raises or lowers a spring cam 85 changing the timing spring 16 force, and so the injection point can be preset. The timing screw 81 is lockable by means of a locking nut to hold the timing cam at any given setting. The cam washer 83 has a number of tabs 84 (FIG. 4) which locate in complementary slots machined in the injector body 2 to prevent it from rotating. It will be noted that the cam washer 83 and spring cam are formed by a pair of mating co-axial rings, the mating surfaces forming cam and cam follower surfaces respectively, and together form a spring cam for spring adjustment in response to the fuel setting of the pump. The spring cam 85 is splined to the fuel pump cylinder 15 but is free to slide up and down on portion of the cylinder 15 and the spring cam 85 has on its upper side a cam surface 86 which acts against the underside cam surface 87 of the cam washer 83. The cam profiles are designed to change the timing spring 16 force by a desired amount when the cylinder 15 is rotated to meter fuel so that automatic advance and retarding of the injection timing is achieved with changes in engine speed.

In use, when the combustion chamber gases which act on an outer portion of the nozzle assembly 6 reach a pressure high enough to overcome the timing spring 16 the piston assembly 7 moves inwardly to allow the combustion chamber gases up under the wider part 10 of the piston assembly 7. This being of much greater area than the outer portion of the nozzle assembly 6 gives a two-stage lift with a snap action on the second stage so that the nozzle assembly 6 lifts at very high speed giving a good pumping action. Advantageously, the two-stage lift allows a lighter timing spring 16 to be used.

At the top of its stroke, the valve head 21 on the nozzle body 62 which projects through the passage 9 forms a seal with the collets 20 at the outer end of the passage 9 to prevent the engine combustion gases from entering the bore 8 where carbon build-up would occur. As the nozzle assembly 6 rises the shoulder 25 on the nozzle body 62 limits the gas pressure within the bore 8 in order that the spring 16 force will be adequate to break this seal after injection, and also to improve the engine compression ratio by extracting less gas from the combustion chamber.

Operation of the nozzle assembly is as follows:

$P_c$—is the cylinder pressure at the end of compression, $P_k$—is the cylinder pressure during combustion, $P_e$—is the cylinder pressure at exhaust, $A_p$—is the cross-sectional area of the wider part of the piston, $A_n$—is the cross-sectional area of an outer end face of the nozzle assembly, and $F_s$—is the downward force exerted by the spring on the piston assembly, Then for opening $P_c \times A_n > F_s$—thus, the piston is moved inwardly and the gases can then act on the wider part of the piston, the greater upward forces:

$P_c \times A_n + P_c X A_p > F_s$—causing the piston to snap inwardly.

During combustion $P_c \times A_p + P_K \times A_n > F_s$—thus the nozzle is retained closed and sealed against the collets 20.

In the latter stages of the power stroke the cylinder pressure will drop so for closing:

$P_e \times A_n + P_c \times A_p < F_s$—thus, the piston assembly will move outwardly releasing the enclosed air which blows down through the cylinder for improved scavenging. It will be noted that during opening as the spring is compressed, the spring force will be increased and this spring force would be sufficient to overcome the upward force due to the gases within the bore acting on the wider part of the piston. However, the additional upward force due to the combustion chamber gases acting on an outer face of the nozzle is sufficient to maintain the piston in the inward position. The cross-sectional area of the outer face of the nozzle is selected such that as the cylinder pressure falls the upward force due to the nozzle falls sufficiently at or just slightly before exhaust to allow the spring move the piston outwardly for blow down of gases from the bore in the injector body.

Due to the speed at which the piston lifts the nozzle piston—piston assembly will complete fuel injection within less than 1° of engine flywheel rotation (i.e. crank angle). This means that the combustion is not propagated until after the injection is completed and therefore pneumatic lift of the piston is achieved and only charge air enters the bore.

Figure 6:
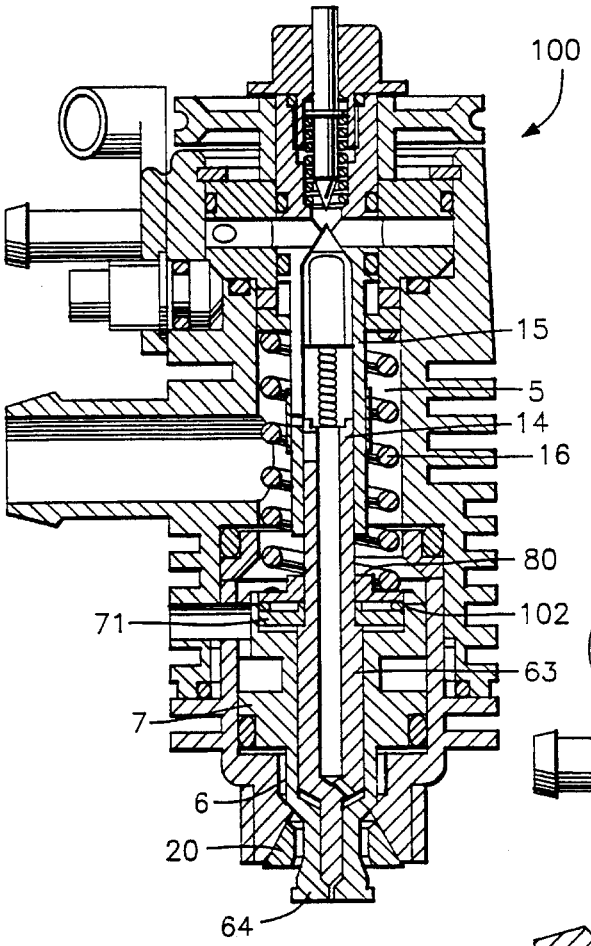
FIG. 6 is a view similar to FIG. 2 of another injector assembly.

Referring now to FIG. 6 there is illustrated another fuel injector assembly 100. This is largely similar to the fuel injector assembly described previously with reference to FIGS. 1 to 5 and like parts are assigned the same reference numerals. In this case the timing spring 16 is also used to urge the needle 63 downwardly to close the atomiser 64. The snap clearance is achieved between the needle washer 71 and the circlip 102 at an upper end of the piston assembly 7 against which the spring locating washer 80 is urged by the spring 16.

Figure 7:
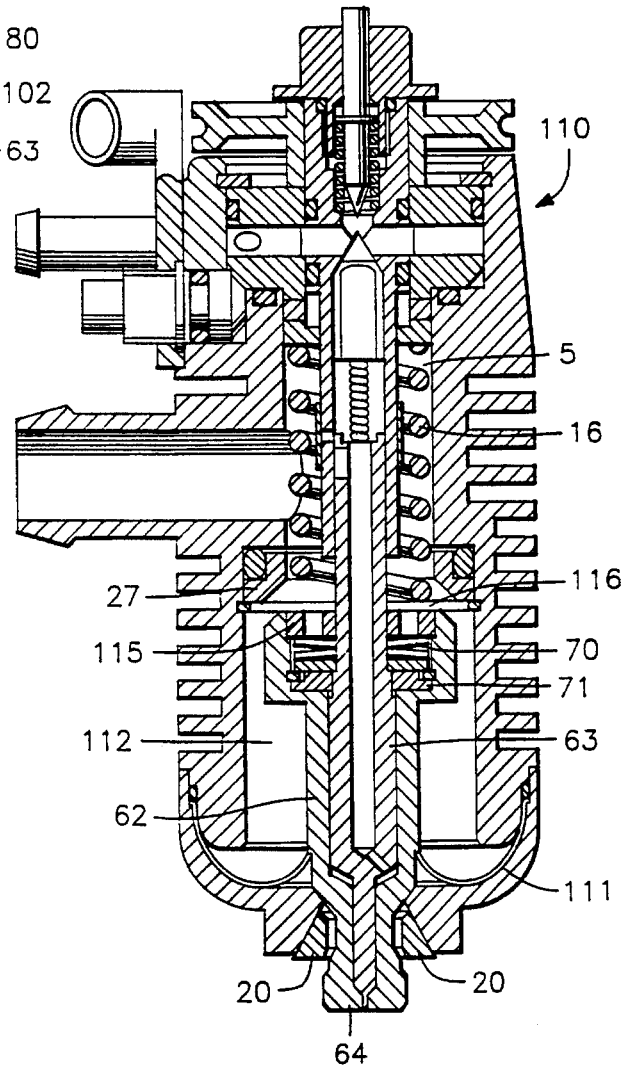
FIG. 7 is a view similar to FIG. 2 of a still further injector assembly.

Referring now to FIG. 7 there is illustrated another fuel injector assembly 110 which is largely similar to the fuel injector assembly of FIGS. 1 to 5 and like parts are assigned the same reference numerals. In this case the wider part of the piston is formed by a diaphragm spring 111 which is fitted at its centre to the nozzle body 62 forming a gas-tight seal and at its outer edge it is secured at a side wall of the bore 8 thus forming a seal between engine combustion chamber gases and fuel oil within the injector body 2. When the nozzle assembly 6 is retracted and the buffer 27 is engaged a quantity of fuel is trapped in the space 112 behind the diaphragm spring 111 giving hydraulic support to the diaphragm spring 111 to prevent crushing in the event of the seal at the collets 20 failing.

Further, in the injector assembly 110 adjustment of the loading on the disk springs 70 is provided for by a threaded adjustor nut 115 and its associated locking ring 116 which can be moved towards and away from the needle washer 71 to adjust the spring loading.

Figure 8:
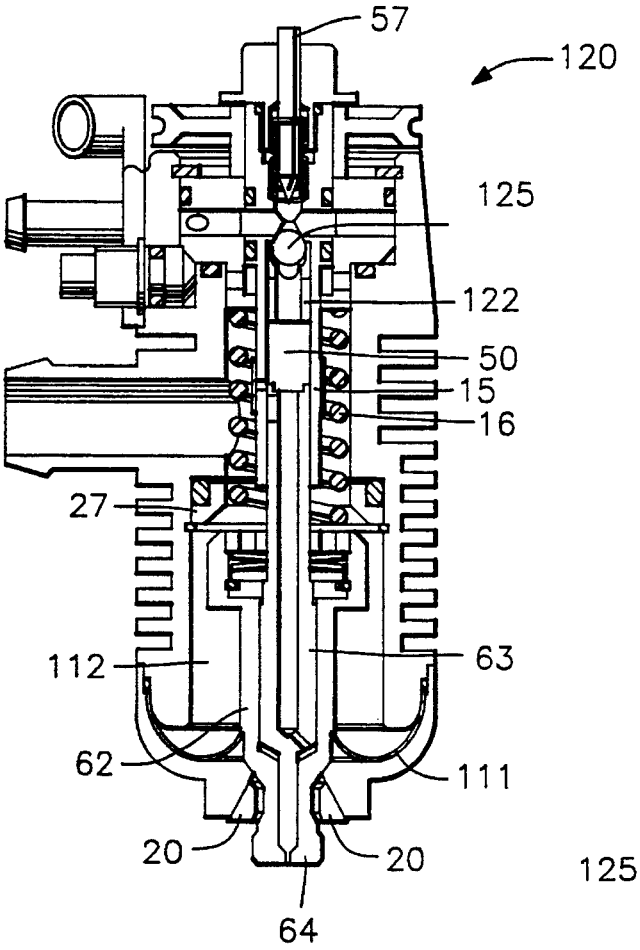
FIG. 8 is a view similar to FIG. 7 of another injector assembly.
Figure 9:
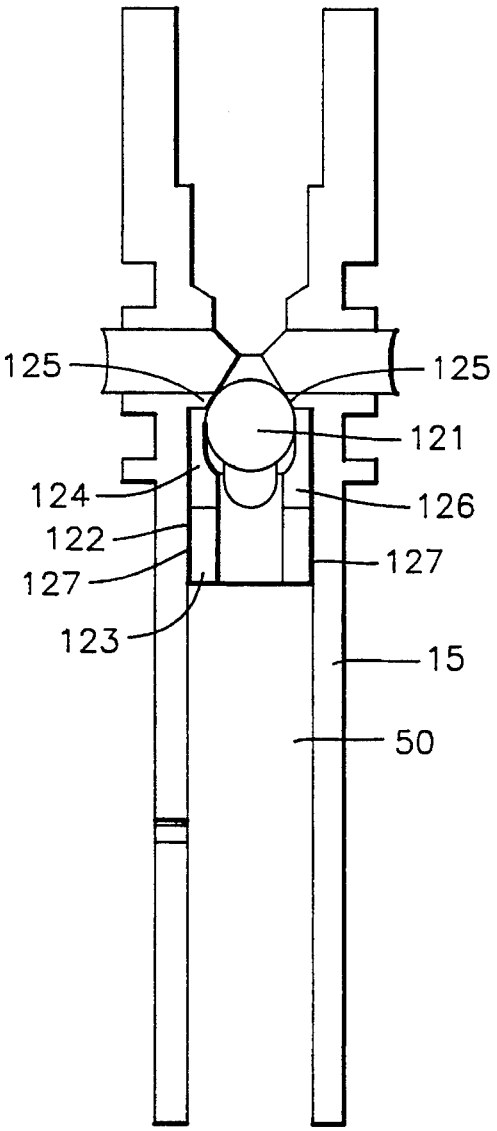
FIG. 9 is a detail sectional elevational view of a fuel pump cylinder portion of the injector assembly of FIG. 8 showing a non-return fuel inlet valve arrangement.

Referring now to FIGS. 8 and 9 there is illustrated another fuel injector assembly 120 which is largely similar to the fuel injector assembly of FIG. 7 and like parts are assigned the same reference numerals. In this case, the fuel injector assembly of FIG. 8 has an alternative fuel inlet non-return valve for the fuel pump cylinder and this arrangement could be used in any of the previously described fuel injector assemblies. The fuel inlet valve comprises a ball 121 loosely mounted within a carrier 122 housed within an upper end of the fuel cup 50. The carrier 122 has a tubular base portion 123 with number of spaced-apart upstanding arms 124 which act as a ball guide. The ball 121 can seat against a fuel inlet opening 125 at a top of the fuel cup 50 and is moveable downwardly guided by the arms 124 against stop shoulders 126 on the arms 124. The ball 121 is moveable between the opening 125 and the stop shoulders 126 in response to fuel pressure. It wall be noted that an outer surface of the carrier 122 has splines 127 to allow air venting towards the fuel inlet opening 125 when the injector 120 is used in a horizontal position. Advantageously, the ball 121 has a low mass making it very responsive and the tickler assembly described previously for the purposes of aerating the fuel cup is no longer required although it may be retained as shown to provide an emergency engine stop facility.

I claim:

1. A fuel injector assembly (1,100,110,120) incorporating a fuel pump (5) of the type comprising an injector body (2) and a two-stage snap-action lift stepped piston (7) mounted in a bore (8) in the injector body (2) having a gas passage (9) at one end for communicating with an engine combustion chamber, the piston (7) having a wider part (10) slidable within the bore (8) and a narrowed part extending through the gas passage and urged by a timing spring (16) into engagement with a first internal sealing land (19) for the gas passage (9) to form a gas-tight seal until the pressure of combustion chamber gases acting on an outer portion of the narrowed part is sufficient to overcome spring pressure and move the piston (7) for inlet of combustion chamber gases to act on the wider part (10) of the piston (7) whereby the piston (7) snaps inwardly under the increased force acting against the spring (16) due to the increase in exposed area acted on by the gases, valve means (20,21) for sealing the gas passage (9) when the piston (7) is moved inwardly, a fuel pump (5) mounted on the piston (7), the pump (5) comprising a plunger (14) for reciprocal pumping movement within a complementary fuel pump cylinder (15) communicating with the bore (8) to deliver a measured quantity of fuel to a nozzle assembly (6) mounted on the outer end the piston (7) in the gas passage (9) in the nozzle assembly (6) forming part of the narrowed part of the piston, through fuel passage (66) in the piston (7) between the fuel pump cylinder (5) and the nozzle assembly (6), characterised in that the valve means (20,21) is formed by a second external sealing land and (20) for the gas passage (9) an the nozzle assembly (6) which is engageable against the second external sealing land (20) upon inward snapping of the piston (7) to form a gas tight seal for retention of purging air.

2. A fuel injector assembly (1,100,110,120) as claimed in claim 1 wherein the second external sealing land (20) is provided adjacent an outer end of the gas passage (9) to isolate the interior of the injector assembly (1) from combustion gases.

3. A fuel injector assembly (1,100,110,120) as claimed in claim 1 wherein the nozzle assembly (6) projects through the gas passage (9) beyond the injector body (2) forming with the gas passage surface a gas inlet (24) until the piston (7) snaps inwardly, the surface of the gas passage (9) which engages the nozzle assembly (6) forming the second land (20).

4. A fuel injector assembly (1,100,110,120) as claimed in claim 3 wherein the nozzle assembly outer surface and gas passage surface defining the gas inlet (24) are so convergently shaped as to reduce the size of the gas inlet (24) as the piston (7) moves inwardly.

5. A fuel injector or assembly (1,100,110,120) as claimed in claim 1 wherein a pair of co-axially mounted spaced-apart valve heads (18,21) are formed on an exterior of the nozzle assembly (6) for engagement with the external and internal sealing lands (19,20) which are formed an outer end and an inner end of the gas (9) respectively.

6. A fuel injector assembly (1,100,110,120) as claimed in claim 5 wherein the valve heads (18,21) and the lands (19,20) are frusto-conical in shape.

7. A fuel injector assembly (1,100,110,120) as claimed in claim 1 wherein a resilient buffer (27,28) is provided for absorbing shock on nozzle assembly engagement with the second external sealing land (20).

8. A fuel injector assembly (1,100,110,120) as claimed in claim 7 wherein the resilient buffer (27,28) is formed by a resilient annular seal 27,28) between an inner face on the piston (7) and a facing annular stop shoulder (29) on the bore (8).

9. A fuel injector assembly (1,100,110,120) as claimed in claim 8 wherein the annular seal (27,28) is so arranged as to trap on engagement a quantity of liquid fuel between the piston (7) and the bore (8) for an additional hydraulic buffer.

10. A fuel injector assembly (1,100,110,120) as claimed in claim 8 wherein the annular seal (27,28) is separately slidable within the bore (8) and engageable between the piston (7) and the bore (8), the piston (7) and seal (27,28) together forming an annular liquid flow throttling passageway.

11. A fuel injector assembly (1,100,110,120) as claimed in claim 10 wherein the annular seal (27,28) comprises a rigid ring support (27) carrying a resilient seal material (28) on its upper surface, a lower surface of the ring support (27) cooperating in use with portion of the surface of the piston (7) to form the throttling passageway.

12. A fuel injector assembly (1,100,110,120) as claimed in claim 11 wherein the cooperating surfaces are not parallel thus avoiding full face to face contact over their cooperating surfaces.

13. A fuel injector assembly (1,100,110,120) as claimed in claim 1 wherein the area of the wider part (10,111) of the piston, the area of the outer face of the nozzle assembly (6), and the timing opting (16) force rating are selected such that the spring force acting on the piston (7) will be greater than the combined inward force of the trapped purging air on the piston (7) and cylinder gases acting on the nozzle assembly (6) at or immediately prior to exhaust of cylinder gases.

14. A fuel injector assembly (1,100,110,120) as claimed in claim 1 wherein the fuel pump plunger (14) has a helical spill groove (65) extending along an exterior of the plunger (14) from a free end of the plunger (14) for cooperation with a spill port (53) in a side wall of the fuel pump cylinder (15) on regulate the quantity of fuel injected by each pump stroke, the cylinder (15) rotatable on the plunger (14) to adjust the effective stroke of the pump (5), rotation of the cylinder (15) operating a spring cam (83,85) for adjustment of the timing spring (16) bias in response to the measured quantity of fuel injected, the spring cam (83,85) comprising a pair of mating co-axial rings (83,85), the mating surfaces forming cam and cam follower surfaces respectively, one ring (83) being held on the body (2) and the other ring (85) engaging the spring (16) and encompassing the fuel pump cylinder (15) being keyed thereon for relative longitudinal movement thereon and hence adjustment of the spring (16).

15. A fuel injector assembly (1,100,110,120) as claimed in claim 1 wherein the nozzle assembly (6) comprises a nozzle body (6) having a through bore for reception of a complementary spring-loaded needle valve (63) to close an atomiser (64) at an outlet of the nozzle body (62), means (66) for fuel delivery from the fuel pump (5) to the outlet, the needle (63) being biased into a closed position by one or more disk springs (70) mounted between the needle (63) and the nozzle body (6).

16. A fuel injector assembly (1,100,110,120) as claimed in claim 14 wherein a non-return valve (54) is provided at the fuel spill port (53) on the fuel pump cylinder (15).

17. A fuel injector assembly (1,100,110,120) as claimed in claim 16 wherein the non-return valve (54) is formed by a resilient compression ring which is mounted around the cylinder (15) covering the spill port (53), the compression ring deformable outwardly for discharge of fuel from the fuel pump cylinder (15).

18. A fuel injector assembly (1,100,110,120) as claimed in claim 1 wherein a non-return valve (51,121) is provided at a fuel inlet to the fuel pump cylinder (15).

19. A fuel injector assembly (1,100,110,120) as claimed in claim 18 wherein the non-return valve comprises a valve (51,121) spring loaded into engagement with a fuel inlet opening in a side wall of the fuel pump cylinder (15).

20. A fuel injector assembly (120) as claimed in claim 18 wherein the non-return valve comprises a ball (121) loosely mounted within a carrier (122) housed within the cylinder (15) at a fuel inlet opening (125) in the cylinder sidewall for movement against and away from the opening (125) in response to fuel pressure.

21. A fuel injector assembly (1,100,110,120) as claimed in claim 14 wherein additional means is provided for calibration of spring (16) tension, and hence the initial injection set point independently of the fuel pump (5) setting.

22. A fuel injector assembly (1,100,110,120) as claimed in claim 21 wherein said additional means is a height adjusting cam (82) formed by a ring gear having an upstanding cam head (88) engagable with a cam surface formed on the spring cam (83), the ring gear being rotatable by a cooperating bevel gear though by a screw shaft (81) mounted on and extending through a side wall of the injector body (2).

23. A fuel injector assembly (110,120) as claimed in claim 1 wherein the wider part of the piston is formed by a resilient diaphragm (111) extending between the nozzle body (6) and a side wall of the gas cylinder.

24. A fuel injector assembly (1,100,110,120) as claimed in claim 1 wherein the second external sealing land at an outer periphery of the gas passage is formed by a pair of split collets (20) releasably secured at an outer end of the gas passage (9).

* * * * *